United States Patent [19]

Pellegrini, Jr.

[11] 4,238,343

[45] Dec. 9, 1980

[54] HIGH FIRE POINT ALKYLAROMATIC INSULATING FLUID

[75] Inventor: John P. Pellegrini, Jr., O'Hara Township, Allegheny County, Pa.

[73] Assignee: Gulf Research & Development Company, Pittsburgh, Pa.

[21] Appl. No.: 954,923

[22] Filed: Oct. 26, 1978

[51] Int. Cl.[3] ..... H01B 3/22

[52] U.S. Cl. ..... 585/24; 252/66 585/323; 585/455; 585;456; 585/6.3

[58] Field of Search ..... 252/63, 66; 174/17 LF; 260/671 B, 671 G; 585/455, 456, 323, 24

[56] References Cited

U.S. PATENT DOCUMENTS

| | | | |
|---|---|---|---|
| 3,036,010 | 5/1962 | Freier et al. | 252/63 |
| 3,104,267 | 9/1963 | Antonsen et al. | 585/456 |
| 3,456,027 | 7/1969 | Culbertson et al. | 585/323 |
| 3,600,451 | 8/1971 | Rowe | 585/24 |
| 3,812,036 | 5/1974 | Romine | 260/671 B X |
| 4,011,166 | 3/1977 | Schenach | 260/671 G X |
| 4,013,736 | 3/1977 | Woo | 260/671 B X |

FOREIGN PATENT DOCUMENTS

| | | | |
|---|---|---|---|
| 946540 | 1/1964 | United Kingdom | 252/63 |

*Primary Examiner*—Harris A. Pitlick

[57] ABSTRACT

A synthetic oil useful as an insulating fluid in electrical apparatus is prepared by reacting an aromatic compound with the oligomers of four to 12 carbon alpha-olefins containing predominantly at least about 30 carbon atoms up to about 60 carbon atoms. A synthetic insulating oil for electrical power transformers is prepared by reacting benzene in a 1:1 molar ratio with a tetramerpentamer mixture obtained by the oligomerization of 1-decene.

9 Claims, No Drawings

HIGH FIRE POINT ALKYLAROMATIC INSULATING FLUID

SUMMARY OF THE INVENTION

This invention relates to synthetic oils useful for the insulation of electrical apparatus and more particularly it relates to the preparation and use in electrical power transformers of novel mono- and dialkylates of an aromatic compound in which the alkylate portion is an oligomer of a four to 12 carbon alpha-olefin containing predominantly at least about 30 carbon atoms up to about 60 carbon atoms.

DETAILED DESCRIPTION OF THE INVENTION

Large electrical power transformers are extensively used in the transmission of electrical power, both at the generating end and the user's end of the power distribution system. These transformers are generally liquid cooled to dissipate the relatively large quantities of heat generated within the transformer during normal operation. Highly refined mineral oil performs these functions outstandingly. However, when these large power transformers are used in close proximity to groups of people or in buildings such as apartment buildings, hospitals, factories and the like, safety considerations regarding the possibility of injury or damage from the mineral oil due to its flammability become a serious problem. A typical light mineral oil transformer fluid suitable for general transformer use has a fire point of about 160° to 165° C. (ASTM D92) and a flash point of about 145° to 150° C. (ASTM D92). For many years these fire safety problems has been very aptly overcome by the use of various polychlorinated biphenyl compositions. But only recently those polychlorinated biphenyl compositions have fallen into disfavor due to their toxicity and capacity for environmental damage aggravated by their resistance to degradation.

The electrical power equipment industry has been seeking a suitable alternative to the polychlorinated biphenyl compounds. An acceptable power transformer insulator must possess not only acceptable electrical and physical properties, but must also be less flammable as evidenced by a high fire point, be environmentally compatible, and be reasonably priced. Various substitutes for the polychlorinated biphenyls have been proposed but all are deficient as to one or more of these requirements.

Dimethyl silicone meets many of the requirements and is in current use, but it is nonbiodegradable and is considered to be much too expensive to capture a substantial portion of the requirements. In U.S. Pat. No. 4,082,866 several saturated hydrocarbon oils are described which have a number of desirable properties for power transformer use. However, they are also significantly deficient in other properties. For example, the paraffinic oil disclosed in this patent desirably possesses a high fire point but undesirably it also possesses a high viscosity and high pour point while the naphthenic oil described in this patent possesses a suitable viscosity but has a low fire point and a high pour point.

Since in preceding years the established insulating fluid product specifications had been adapted to fit the exceptional low flammability properties of the polychlorinated biphenyls, it is not expected that a suitable replacement fluid can meet these specifications. Although various revised specifications have been proposed, the 1978 National Electrical Code has now specified in article 45-23 that the fire point of a transformer fluid be not less than 300° C. to qualify as a high fire point transformer fluid.

The fire point as determined by ASTM D92 is a critical property of a fire-resistant transformer fluid. The fire point represents that temperature of the fluid at which sustained combustion occurs when exposed to the atmosphere. It is preferred that the fire point of a transformer fluid intended for general use be at least about 275° C. (527° F.) for reasonable safety against the various hazards inherent with low flammable fluids and more preferably should be at least about 300° C. (572° F.) in order to meet current specifications for high fire point transformer fluids.

Because insulating fluids serve to cool the transformer by convection, the viscosity properties of a transformer's insulating fluid are the principal factor in determining its effectiveness in the dissipation of heat. Viscosity is a measure of the resistance of a fluid to flow. At the lower viscosities a transformer fluid possesses better internal fluid circulation and better heat removal. But reducing the overall carbon number of an oil to reduce its viscosity also tends to significantly reduce its fire point. Conversely, in attempting to increase the fire point by using higher carbon number oils generally results in the use of significantly more viscous oils. The superior insulating fluid possesses a low viscosity at all temperatures over a useful range while maintaining adequate protection against flammability. The superior insulating fluid also possesses a high viscosity index. In particular, it exhibits a low viscosity at elevated temperatures, such as at 100° C. and higher in order to protect the transformer against the development of hot spots. An acceptable transformer fluid can possess a 98.9° C. (210° F.) viscosity as high as 20 cs. but it is preferred that a transformer fluid have a maximum 98.9° C. (210° F.) viscosity of about 15 cs. and that it have a viscosity index of at least about 110. It is most preferred that the transformer fluid have a maximum 98.9° C. (210° F.) viscosity of about 12 cs.

Pour point is also significant in the overall usefulness of the transformer fluid, particularly with regard to starting equipment in cold climates. A maximum pour point of −25° F. (−31.7° C.) is considered to be essential while a maximum of about −40° C. (−40° F.) is preferred for the transformer fluid. Pour point depressants are well known but their use in transformer fluids is not favored because of the possibility that these materials may decompose in service with time. Also even with the use of a pour point depressant, it may not be possible to achieve the desired pour point. Therefore, it is desired that the unmodified transformer fluid have an acceptable pour point.

The tendency of a transformer fluid to form gas as determined by ASTM D2300B is another characteristic which is important in some specifications. In this test a 10,000 volt a.c. current is applied to two closely spaced electrodes, one being immersed in the transformer fluid under a hydrogen atmosphere. The amount of pressure elevation is an index of the amount of decomposition resulting from the electrical stress that is applied to the liquid. A pressure decrease, indicated by a negative pressure reading is indicative of a liquid which is stable under the corona forces and which is a net absorber of hydrogen.

I have discovered that a novel, synthetic transformer fluid can be prepared which meets the electrical and physical requirements in an exemplary manner and which possesses substantially lower flammability than conventional mineral oil transformer fluids and is environmentally safe. I have found that this novel transformer fluid can be prepared by reacting an aromatic compound with an oligomer fraction obtained by the oligomerization of an alpha-olefin or a mixture of two or more oligomer fractions. The alpha-olefin oligomer which is useful in preparing the novel transformer insulating fluid will have at least about 30 carbon atoms per molecule up to about 60 carbon atoms per molecule and preferably will have between about 40 and about 50 carbon atoms per molecule. The alpha-olefin oligomer reactant can be prepared from 1-butene, 1-hexene, 1-octene, 1-decene and 1-dodecene or a mixture of two or more of these 1-olefins, with 1-decene preferably being the predominant or only alpha-olefin reactant. Also, the oligomer reactant can be an oligomer mixture prepared from oligomer fractions prepared from different 1-olefins or mixtures of 1-olefins.

The oligomerization reaction can be suitably effected with a boron trifluoride-containing catalyst in a manner well known in the art. Unreacted monomer and dimer are separated from the oligomer product mixture. In the case of 1-decene, the remainder is the trimer, tetramer, pentamer and generally a small amount of higher oligomers, primarily the hexamer, usually comprising no more than a few percent of this mixture. This oligomer mixture can be reacted with the aromatic compound without further separation or the trimer can be separated out by vacuum distillation and used separately. Due to difficulty in separation, the tetramer and pentamer of 1-decene are generally utilized as a mixture without separation. When the expression pentamer of 1-decene is used herein, it is to be understood that the term is intended to include the minor amount of hexamer and higher oligomers that may be present. Processes for oligomerizing an alpha-olefin to the oligomers, particularly the trimer, tetramer and pentamer, with a boron trifluoride catalyst are disclosed in U.S. Pat. Nos. 3,149,178; 3,382,291; 3,742,082; 3,763,244; 3,769,363; 3,780,128; and 3,997,621. These oligomer products can also be prepared with other catalysts such as a suitable aluminum trichloride catalyst as described in U.S. Pat. No. 3,842,134.

The alpha-olefin oligomer fraction or a mixture of these oligomer fractions is reacted with an aromatic compound, preferably an aromatic hydrocarbon. The useful aromatic compounds include an aromatic hydrocarbon having from six to eight carbon atoms such as benzene, toluene, xylene and ethylbenzene and also include naphthalene, diphenyl ether, chlorobenzene, bromobenzene, and the like. The reaction is preferably carried out under conditions and proportions of reactants directed to the monoalkylation of the aromatic compound, although the dialkylated product can be prepared by using a substantial excess of the oligomer and this material is also useful as a transformer fluid hereunder. In some instances the reaction product is a mixture of the mono- and dialkylate. Anhydrous aluminum trichloride is a suitable catalyst for preparing the novel insulating fluid. A reaction temperature of between about 15° and about 80° C., preferably between about 20° and about 40° C., is suitable for the alkylation reaction. In order to activate the aluminum trichloride, a small amount of water or hydrogen chloride gas must be added to the reactor. The water naturally present in nondried reactants may be sufficient for this purpose.

DESCRIPTION OF PREFERRED EMBODIMENTS

The 1-olefin oligomer compositions used in the following examples were prepared from 1-decene by the method described in U.S. Pat. No. 4,045,507. In the following examples the kinematic viscosities were determined by ASTM D445, the viscosity index by ASTM D2270, the pour point by ASTM D97, flash point and fire point by ASTM D92, the oxidation stability by ASTM D2440, the gassing tendency by ASTM D2300B, the power factor and dielectric constant by ASTM D924 and the dielectric strength by ASTM D877.

EXAMPLE 1

A reaction between dried benzene and a dried 1-decene oligomer was carried out in a 30 gallon, glasslined, stirred tank reactor under a nitrogen atmosphere. The composition of the 1-decene oligomer was 6.5 weight percent trimer, 53.0 percent tetramer and 40.5 percent pentamer. A total of 29.83 kg. of benzene, 557 g. of anhydrous aluminum trichloride, 36.5 g. of hydrogen chloride gas and 20.13 kg. of the 1-decene oligomer were charged to the reactor. The temperature was maintained within the range of 21°–23° C. over a nine and one-half hour period. The catalyst, which had settled out as a red, insoluble liquid, was deactivated and separated from the product. The product liquid was analyzed by NMR and it was determined that there was no unreacted olefin in the reactor and that the product was all monoalkylate. The product was distilled to remove excess benzene and lower boiling components. The bottoms portion weighed 18.43 kg. which was 89.9 percent of the total product giving a yield of 99.3 percent based on the 1-decene tetramer and higher portion of the feed.

This oligomer-benzene product was analyzed and compared in Table I with a commercially available heavy paraffinic mineral oil and a silicone fluid used as a transformer fluid, technically polydimethylsiloxane but commonly called dimethyl silicone.

Table I

| | Oligomer-benzene product | Mineral oil | Dimethyl silicone |
|---|---|---|---|
| Viscosity, | | | |
| 98.° C. (210° F.), cs. | 13.1 | 16.5 | 16 |
| 37.8° C. (100° F.), cs. | 117.3 | — | — |
| Viscosity Index | 115 | 102 | — |
| Pour point, °C. (°F.) | −48.3(−55) | −28.9(−20) | 55(−67) |
| Power factor,% | | | |
| 25° C. (77° F.) | 0.003 | 0.012 | 0.6 |
| 100° C. (212° F.) | 0.35 | 0.80 | 0.9 |
| Dielectric strength,kV. | 40 | 29 | 34 |
| Volume resistivity, ohm-cm × $10^{-12}$ | 700 | 11 | 560 |
| Oxidation stability | | | |
| Sludge,% | | | |
| 72 hours | 0.003(1) | 0.006 | — |
| 164 hours | 0.003(1) | 0.008 | — |
| Total Acid No., | | | |
| 72 hours | 0.16(1) | 0.89 | — |
| 164 hours | 0.21(1) | 2.30 | — |
| Gassing tendency, $mm^3$/min. | −7.8 | 8.4 | — |
| Flash point, °C. (°F.) | 300(572) | 279(534) | 300(572) |

Table I-continued

| | Oligomer-benzene product | Mineral oil | Dimethyl silicone |
|---|---|---|---|
| Fire point, °C. (°F.) | 321(610) | 316(601) | 360(680) |

(1)Fluid contains 0.30 percent dibutyl p-cresol.

EXAMPLE 2

The following reaction was carried out in a two-liter, three-necked round-bottom flask equipped with a stirrer and heating mantle. A 780 g. quantity of benzene was charged into the reactor. After purging with nitrogen 13.3 g. of aluminum trichloride catalyst were added with stirring. A 590 g. portion of the tetramer fraction of a 1-decene oligomer was added dropwise over a one-hour period to maintain the temperature between 30° and 40° C. The tetramer fraction had a 98.9° C. (210° F.) viscosity of 6.8 cs., a viscosity index of 134, a pour point lower than −54° C. (−65° F.) and a fire point of 299° C. (570° F.) and analyzed 15.5 percent trimer, 63.7 percent tetramer, 16.1 percent pentamer and 4.7 percent hexamer. After the addition of the oligomer was completed, the temperature was raised to 80° C. and maintained for two hours. After separating and washing the organic portion, it was stripped of light ends to a final pot temperature of 275° C. at 1.0 mm. Hg. The product weighed 611 g. which was about 90 percent of theoretical. The product characteristics are set out in Table II.

EXAMPLE 3

Example 2 was repeated at room temperature. The properties of the product are set out in Table II.

EXAMPLE 4

Example 2 was repeated except that 920 g. of toluene were used in place of the benzene. The product was acid washed and neutralized with base. A 639 g. product was obtained after stripping off light ends to a final pot temperature of 300° C. at 4.0 mm. Hg. The results of the various tests are set out in Table II.

Table II

| | Ex. 2 | Ex. 3 | Ex. 4 |
|---|---|---|---|
| Viscosity,cs. at | | | |
| 37.8° C. (100° F.) | 85.1 | 113 | 99 |
| 98.9° C. (210° F.) | 10.5 | 12.8 | 11.2 |
| Viscosity Index | 116 | 116 | 108 |
| Pour point,°C.(°F.) | −53.9(−65) | −48.3(−55) | −51.1(−60) |
| Flash point,°C.(°F.) | 285(545) | 293.3(560) | 290.5(555) |
| Fire point,°C.(°F.) | 304.5(580) | 315.5(600) | 310(590) |

EXAMPLE 5

A monoalkylate of benzene was made by reacting it with a trimer fraction of 1-decene. This trimer fraction analyzed 100 percent trimer by gas chromatograph. One grammol of this trimer fraction was reacted with 10 grammols of benzene using 0.1 grammol of aluminum trichloride at a maximum temperature of 40° C. over a period of 24 hours. There was a 67 percent yield of the monoalkylate product based on the olefin. This product demonstrated a flash point of 268.3° C. (515° F.) and a fire point of 296.1° C. (565° F.).

EXAMPLE 6

Two grammols of the trimer described in Example 5 were reacted with one-half grammol of benzene using one-half grammol of aluminum trichloride at a maximum temperature of 29° C. over a period of 120 hours. The yield of the dialkylate was 24 percent based on the olefin. This benzene dialkylate exhibited a flash point of 318.3° C. (605° F.) and a fire point of 337.8° C. (640° F.).

EXAMPLE 7

One grammol of the 100 percent trimer fraction was reacted with five grammols of diphenyl using 0.2 grammol of aluminum trichloride at a maximum temperature of 49° C. for 24 hours. A 44 percent yield of the 1:1 reaction product was obtained having a 298.9° C. (570° F.) flash point and a 316° C. (600° F.) fire point.

EXAMPLE 8

In a second reaction 0.2 grammol of the 100 percent trimer fraction was reacted with one grammol of diphenyl using 0.04 grammol of aluminum trichloride at a maximum temperature of 34° C. for 72 hours. There was a 59 percent yield of the monoalkylate of diphenyl. This product demonstrated a flash point of 298.9° C. (570° F.), a fire point of 323.9° C. (615° F.), a 98.9° C. (210° F.) viscosity of 15.6 cs. and a pour point of −34.4° C. (−30° F.).

EXAMPLE 9

Diphenyl was also reacted with the tetramer fraction described in Example 2. Two-thirds of a grammol of the tetramer fraction were reacted with two-thirds of a grammol of diphenyl using 0.13 grammol of aluminum trichloride at a maximum temperature of 25° C. and a reaction time of 144 hours. There was a 70 percent yield of the diphenyl monoalkylate. It showed a flash point of 310° C. (590° F.), and a fire point of 329.4° C. (625° F.), and possessed a 98.9° C. (210° F.) viscosity of 19.72 cs. and a pour point of −34.4° C. (−30° F.).

EXAMPLE 10

One grammol of naphthalene was reacted with 0.2 grammol of the 100 percent trimer fraction using 0.02 grammol of aluminum trichloride at a maximum reaction temperature of 44° C. and a reaction time of 24 hours. There was a 68 percent yield of the desired reaction product which exhibited a flash point of 282.2° C. (540° F.) and a fire point of 310° C. (590° F.).

EXAMPLE 11

A 0.7 grammol of naphthalene was reacted with 0.7 grammol of the tetramer fraction described in Example 2 using 0.14 grammol of aluminum trichloride at a maximum temperature of 24° C. and a reaction time of 24 hours. The monoalkylated reaction product was obtained in 76 percent yield. It possessed a 98.9° C. (210° F.) viscosity of 18.34 and a pour point of −37.2° C. (−35° F.) and exhibited a flash point of 298.9° C. (570° F.) and a fire point of 323.9° C. (615° F.).

EXAMPLE 12

A 0.34 grammol portion of the 100 percent trimer fraction was reacted with 0.34 grammol of diphenyl ether using 0.06 grammol of aluminum trichloride at a maximum reaction temperature of 28° C. and a reaction time of 48 hours. The monoalkylate had a 98.9° C. (210° F.) viscosity of 18.4 and a pour point of −37.2° C. (−35° F.) and demonstrated a flash point of 304.5° C. (580° F.) and a fire point of 326.7° C. (620° F.).

EXAMPLE 13

In another reaction 0.66 grammol of diphenyl ether was reacted with the tetramer fraction described in Example 2 using 0.13 grammol of aluminum trichloride at a maximum temperature of 26° C. and a reaction time of 24 hours. The product exhibited a flash point of 310° C. (590° F.), a fire point of 340.5° C. (645° F.), a 98.9° C. (210° F.) viscosity of 21.8 cs. and a pour point of −31.7° C. (−25° F.).

EXAMPLE 14

Two grammols of chlorobenzene were reacted with 0.2 grammol of the tetramer fraction described in Example 2 using 0.2 grammol of aluminum trichloride at a maximum reaction temperature of 80° C. for 24 hours. The yield of the monoalkylate was 42 percent. It exhibited a flash point of 293.2° C. (560° F.) and a fire point of 321.1° C. (610° F.).

EXAMPLE 15

Example 14 was repeated using 0.02 grammol of aluminum trichloride, a maximum temperature of 40° C. and a 20 hour reaction period. The yield increased to 68 percent while the flash point and fire point remained the same.

EXAMPLE 16

Example 15 was repeated except that bromobenzene replaced the chlorobenzene. The yield was 57 percent, the flash point was 290.5° C. (555° F.) and the fire point was 315.5° C. (600° F.).

EXAMPLE 17

A 2.34 kg. quantity of benzene was placed in a twelve-liter, three-necked round-bottom flask equipped with a magnetic stirrer. The system was purged with nitrogen and 40 g. of anhydrous aluminum trichloride were added. A 1.77 kg. quantity of the tetramer fraction as described in Example 2 was added dropwise over a 35 minute period. The temperature rose from 23° C. to 45° C. After 24 hours the contents of the reactor were poured into three liters of water, were washed with dilute sodium hydroxide and dried over anhydrous sodium sulfate. Benzene and the light ends were removed to a maximum pot temperature of 328° C. at 1.7 mm. Hg. The product was 1.86 kg. of a monoalkylate having a flash point of 285° C. (545° F.) and a fire point of 312.8° C. (595° F.).

EXAMPLE 18

Example 17 was repeated. When the product was stripped of light ends at a maximum pot temperature of 324° C. and 1.5 mm. Hg., 1.745 kg. of alkylate were obtained having a flash point of 285° C. (545° F.) and a fire point of 310° C. (590° F.).

The products of Examples 17 and 18 were mixed and the resulting product exhibited a 98.9° C. (210° F.) viscosity of 10.6 cs., a viscosity index of 115, a pour point of −45.6° C. (−50° F.), a flash point of 296.1° C. (565° F.), a fire point of 312.8° C. (595° F.), a dielectric strength of 46 kV., a power factor at 25° C. of 0.003 and at 100° C. of 0.70 and a gassing tendency of −4.0 $mm^3$/min. The product yield for these two reactions was 100 percent based on the 1-decene oligomer fed to the reaction.

EXAMPLES 19–25

A series of experiments were carried out using benzene and the tetramer fraction described in Example 2 to evaluate the effect of variations in the reactants and catalyst and in the reaction time. In a typical run 390 g. of benzene and 13.3 g. of aluminum trichloride were added to a two-liter, nitrogen purged flask equipped with a magnetic stirrer. A 590 g. quantity of the 1-decene oligomer was charged to the reactor as rapidly as possible while maintaining the temperature at 40°–50° C. Neither the benzene nor the oligomer was dried to permit trace water to catalyze the reaction. After about four hours the temperature dropped slowly and after 24 hours it was at room temperature (20°–25° C.). The product was treated with a series of dilute hydrochloric acid, dilute sodium hydroxide and distilled water washings until it was neutral. It was dried and the excess benzene was removed and then stripped of the light ends, including any alkylate of the trimer present, at a pot temperature of 325° C. and a pressure of 1.4 mm. Hg.

The results of these experiments and the product analyses are set out in Table III.

Table III

| Example | 19 | 20 | 21 | 22 | 23 | 24 | 25 |
|---|---|---|---|---|---|---|---|
| Charge | | | | | | | |
| oligomer, mols | 1.0 | 1.0 | 1.0 | 1.0 | 1.0 | 1.0 | 1.0 |
| benzene, mols | 5.0 | 5.0 | 10.0 | 5.0 | 5.0 | 5.0 | 5.0 |
| $AlCl_3$, mols | 0.1 | 0.1 | 0.1 | 0.05 | 0.05 | 0.025 | 0.2 |
| Time, hours | 24 | 4 | 24 | 24 | 4 | 6 | 5 |
| Yield, % | 84 | 84 | 87 | 80 | 85 | 76 | 84 |
| Viscosity, 98.9° C., cs. | 11.4 | 8.4 | 10.5 | 10.4 | 7.34 | 6.98 | 10.5 |
| Viscosity index | 115 | 135 | 117 | 123 | 138 | 137 | 122 |
| Pour point, °C. (°F.) | −48.3(−55) | −51.1(−60) | −48.3(−55) | −51.1)−60) | −51.1(−60) | −53.9(−65) | −51.1(−60) |
| Flash point, °C., (°F.) | 293.3(560) | 279.5(535) | 285(545) | 282.2(540) | 268.3(515) | 257.2(495) | 279.5(535) |
| Fire point, °C. (°F.) | 315.5(600) | 304.5(580) | 307.2(585) | 307.2(585) | 293.3(560) | 285(545) | 307.2(585) |

In several of these experiments samples were taken during the reaction and analyzed by NMR. It was determined that after two hours no oligomer was detected in Example 19 which involved a benzene to oligomer ratio of 5:1 while in Example 21 which used a benzene to oligomer ratio of 10:1, no oligomer was detected after one hour. However, a comparison of Examples 19 and 20 or 22 and 23 suggests that reactions are taking place after four hours of reaction time and that this additional reaction time is necessary to increase the fire point of the product. A comparison of Examples 19 with 22 and 20 with 23 indicates that insufficient aluminum trichloride catalyst also decreases the fire point of the product while a comparison of Examples 22 and 25 indicates that excess aluminum trichloride can produce the same fire point in a much shorter reaction time.

EXAMPLE 26

The 1-decene oligomer described in Example 1 was reacted with toluene in a two liter reactor. Although the feed was undried, 1.8 g. of hydrogen chloride was used to insure reaction. The other components comprised 731.4 g. of toluene, 675 g. of the 1-decene oligomer and 13.3 g. of aluminum trichloride. The reactor was maintained at a temperature between 24° and 35° C. for a period of 24 hours. The excess toluene and lower boiling components were distilled off. The product yield was determined to be 102 percent based on the 1-decene tetramer and higher portion of the feed.

This product was found to have a 98.9° C. (210° F.) viscosity of 13.6 cs., a 37.8° C. (100° F.) viscosity of 129.5 cs., a viscosity index of 110, a pour point of −40° C., a flash point of 296.1° C. (565° F.) and a fire point of 323.9° C. (615° F.). It was found to have a gassing tendency of −7.4 $mm^3$/min. The power factor at 25° C. (77° F.) was determined to be 0.005 and 0.100 at 100° C. and the dielectric strength was found to be 0.30 kV. In the oxidation tests using 0.30 weight percent dibutyl p.cresol inhibitor, it developed 0.005 percent sludge after 72 hours and 0.006 percent sludge after 172 hours and exhibited a total acid No. of 0.11 after 72 hours and 0.16 after 172 hours.

The polychlorinated biphenyls because of their excellent fire resistance together with their good electrical and physical properties have been the standard transformer fluid in applications where fire hazards are significant. But because of environmental and toxicological considerations, their use has recently been proscribed. The novel compositions of the present invention present no such problems. In these considerations they are essentially similar to mineral oil. They are considered to be toxicologically inactive and decompose by microbial action if accidentally or negligently released to the environment. Their decomposition products are water and carbon dioxide. In contrast, dimethyl silicone is regarded as nonbiodegradable but is not regarded to be toxicologically hazardous.

It is to be understood that the above disclosure is by way of specific example and that numerous modifications and variations are available to those of ordinary skill in the art without departing from the true spirit and scope of the invention.

I claim:

1. A high fire point synthetic hydrocarbon suitable for use in oil filled electrical apparatus, said synthetic hydrocarbon consisting essentially of the monoalkylate or dialkylate reaction product or a mixture thereof of a preformed oligomer fraction consisting essentially of at least 30 and up to about 60 carbon atoms per molecule or a mixture thereof and prepared solely from a normal alpha-olefin selected from 1-butene, 1-hexene, 1-octene, 1-decene and 1-dodecene and mixtures thereof with an aromatic composition selected from aromatic hydrocarbons having from six to eight carbon atoms, chlorobenzene, bromobenzene, diphenyl, diphenyl ether, naphthalene and mixtures thereof and characterized by a maximum 98.9° C. (210° F.) viscosity of about 20 cs., a viscosity index of at least about 110, a maximum pour point of about −25° F. (−31.7° C.), a fire point of at least about 300° C. (572° F.) and a negative gassing tendency.

2. A high fire point synthetic hydrocarbon in accordance with claim 1 in which said synthetic hydrocarbon is the monoalkylate reaction product of said oligomer and said aromatic composition.

3. A high fire point synthetic hydrocarbon in accordance with claim 2 in which the 98.9° C. (210° F.) viscosity is a maximum of about 15 cs and the viscosity index is at least about 115.

4. A high fire point synthetic hydrocarbon in accordance with claim 3 in which the 98.9° C. (210° F.) viscosity is a maximum of about 12 cs.

5. A high fire point synthetic hydrocarbon in accordance with claim 3 or 4 in which the said oligomer comprises predominantly a mixture of 1-decene tetramer and pentamer and the aromatic composition is benzene.

6. A high fire point synthetic hydrocarbon in accordance with claim 3 or 4 in which the said oligomer comprises predominantly the tetramer and pentamer of 1-decene and the aromatic composition is toluene.

7. A high fire point synthetic hydrocarbon in accordance with claim 1 in which said synthetic hydrocarbon is the dialkylate reaction product of said oligomer and said aromatic composition.

8. A high fire point synthetic hydrocarbon in accordance with claim 1 in which said synthetic hydrocarbon is a mixture of the monoalkylate and the dialkylate reaction product of said oligomer and said aromatic composition.

9. A high fire point synthetic hydrocarbon in accordance with claim 1 in which said oligomer fraction contains predominantly between about 40 and 50 carbon atoms.

* * * * *